US005869810A

United States Patent [19]

Reynolds et al.

[11] Patent Number: 5,869,810

[45] Date of Patent: Feb. 9, 1999

[54] IMPEDANCE-HEATED FURNACE

[75] Inventors: Victor R. Reynolds, St. Marys, Md.; Gary L. White, St. Louis, Mo.

[73] Assignee: Victor Reynolds, Compton, Md.

[21] Appl. No.: 745,243

[22] Filed: Oct. 29, 1996

Related U.S. Application Data

[63] Continuation-in-part of Ser. No. 447,880, May 23, 1995, abandoned.

[51] Int. Cl.[6] ..... F27B 1/12; F27B 9/08; F27B 9/22; F27B 9/36

[52] U.S. Cl. ..... 219/388; 219/427; 373/111; 373/116; 373/119; 34/179; 34/182; 34/578

[58] Field of Search ..... 219/388, 390, 219/406, 407, 409, 427; 34/179, 181, 182, 520, 578; 373/111, 116, 118, 119, 122; 392/409

[56] References Cited

U.S. PATENT DOCUMENTS

| | | | |
|---|---|---|---|
| 652,640 | 6/1900 | Potter | 219/427 |
| 2,489,753 | 11/1949 | Cox | 219/247 |
| 3,175,889 | 3/1965 | Titus et al. | 219/427 |
| 3,583,028 | 6/1971 | Bely . | |
| 3,632,975 | 1/1972 | Ando . | |
| 3,766,357 | 10/1973 | Koester . | |
| 3,777,117 | 12/1973 | Othmer . | |
| 3,823,003 | 7/1974 | Mulcihy | 373/119 |
| 3,961,150 | 6/1976 | Lewis . | |
| 4,039,794 | 8/1977 | Kasper . | |
| 4,055,745 | 10/1977 | Belageuer | 219/406 |
| 4,110,599 | 8/1978 | Offermann . | |
| 4,247,735 | 1/1981 | Rigatti-Luchini | 13/25 |
| 4,408,117 | 10/1983 | Yurkanin . | |
| 4,472,621 | 9/1984 | Blackmore . | |
| 4,578,564 | 3/1986 | Ando . | |
| 4,608,766 | 9/1986 | Kawai . | |
| 4,645,906 | 2/1987 | Yagnik . | |
| 4,699,721 | 10/1987 | Meenan . | |
| 4,704,515 | 11/1987 | Offermann . | |
| 4,931,610 | 6/1990 | Hughes . | |
| 5,144,108 | 9/1992 | Passarotto . | |
| 5,289,640 | 3/1994 | McCabe | 34/182 |
| 5,315,085 | 5/1994 | Ferguson | 219/407 |

FOREIGN PATENT DOCUMENTS

PCT89/00049 11/1989 WIPO .

OTHER PUBLICATIONS

Erickson, C. James, Handbook of Electrical Heating for Industry, p. 218, 1995.

*Primary Examiner*—Teresa J. Walberg
*Assistant Examiner*—J. Pelham
*Attorney, Agent, or Firm*—R. Jonathan Peters

[57] ABSTRACT

There is disclosed an impedance-heated furnace for processing a nonflowable but conveyable material at the processing temperature comprising a nonrotating shell having electrical-conducting properties, and heated to a processing temperature using electrical impedance as the heat source. The shell includes an inlet and an outlet and a conveyor means, which also may be heated by impedance, for transporting or carrying the material along or through the shell. The resulting solids and any generated or volatilized gases are recovered separately.

45 Claims, 9 Drawing Sheets

Figure 7
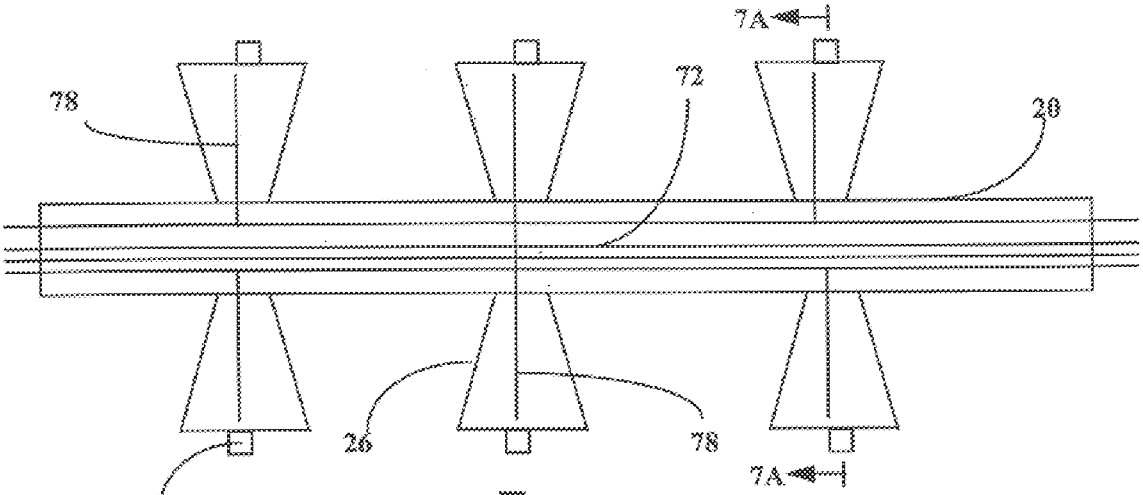
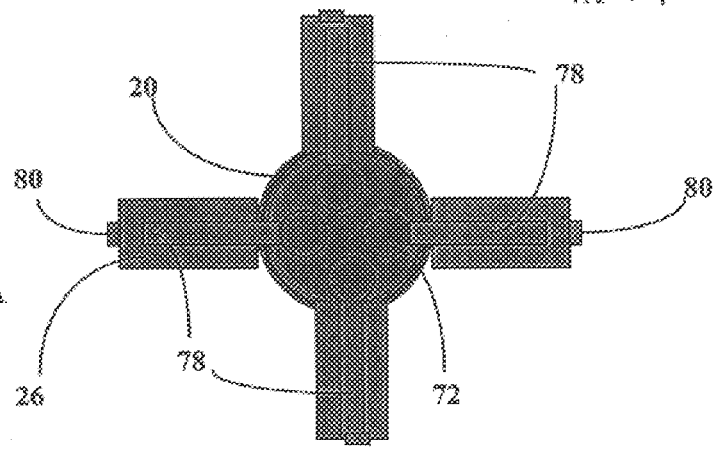
Figure 7A

IMPEDANCE-HEATED FURNACE

This application is a continuation-in-part application of Ser. No. 08/447,880 filed on May 23, 1995 now abandoned.

FIELD OF THE INVENTION

This invention relates to a processing furnace. In its more specific aspect, this invention relates to an electrical impedance-heated furnace for processing materials which are nonflowable but conveyable at the processing temperature.

BACKGROUND AND PRIOR ART

Furnaces, dryers, roasters, and other heat transfer devices have been used in the processing industries for many decades. Some of the more common furnace designs are rotary kilns, multiple-hearth roasters, and fluid-bed roasters. Direct heating for these furnace designs is common, but other processing devices also utilize indirect heat or energy transfer for heating the material being processed in the devices.

Heat transfer devices which circulate preheated liquids or vapors in an indirect heat transfer configuration typically comprise a jacketed trough into which single or multiple rotating shafts are inserted. Hollow paddles or screws are attached to the shafts and are the means of conveyance for the feed material through the furnace system. The paddles and screws may be intermeshed to facilitate self cleaning. Heat is transferred to the feed material by the introduction of a preheated medium into the jacket and rotating shaft(s) through a set of rotary joints on each end of the shaft. After passing through the system, the heating medium is returned to a heating device for reheating prior to its return to the heat transfer system. Heating limitations of the feed material in this type of heat transfer device depend on the temperature limitations of the heat transfer medium and the rotary joint seals (which deteriorate with excessive temperature) through which the medium passes. Practical limitations are currently in the 650 to 700 degrees Fahrenheit range.

A multiple-hearth roaster consists of a vertical, refractory-lined metal shell containing tiers or hearths mounted one above each other. Material movement is provided by rabble arms on each hearth attached to a central rotating shaft extending through the center of each hearth from the bottom to the top of the roaster. Material is moved by pitched teeth (material is moved toward the outside on one hearth and toward the center on the next lower hearth) attached to each rabble arm. Material enters the furnace at the top hearth and drops through a hole to the hearth below as the material is rabbled back and forth. Burners may be mounted on all or some of the hearths, and the combustion gas flow is generally from lower-to-upper hearths and countercurrent to the flow of the material being processed. Heat transfer is directly from contact between the combustion gases and the feed material. Disadvantages of a hearth furnace are excessive dusting as the processed material falls from hearth to hearth and large discharge gas volumes requiring treatment since generated process gases are combined with combustion gases.

A fluidized-bed roaster generally consists of a vertical, refractory-line metal shell with single or multiple hearths containing a suspension of the coarser fraction of the feed. In some cases where all process feed exits with the fluidizing gases, an inert bed material such as silica sand is added to the system to act as a heat sink. The fluidization of the coarse feed fraction or inert solids is provided by the flow of air, combustion gases, or other types of gases which enter a plenum chamber and pass upward through a constriction plate having a plurality of orifices and then into the fluidized bed. The fluidizing gases may be preheated, or the heat source may be the combustion of gaseous, liquid, or solid fuels in the bed; or electrical means; or by the exothermic nature of the feed. Material to be processed is injected into or above the fluid bed for direct-contact heat transfer. Processed material is removed from the roaster by overflowing from the lowest fluid bed through a conduit and sealed valves and also by the overhead dust collection system. When inert materials are used for bed material, they are recycled to the system. Major disadvantages of fluid bed roasters are high energy costs, the requirement to handle very large volumes of gases, and a limitation on feed material particle size which generally contain material smaller than one-quarter of an inch.

Rotary kilns are comprised of a horizontally-declined shell rotating on trunnions. Material movement through the shell is provided by rotation of the shell and the decline of the shell from feed to discharge end. Mechanical pitched lifters may also be attached to the inside of the shell to facilitate material movement and mixing. Kilns may be heated either directly or indirectly. Like other furnaces, rotary kilns are usually operated under slightly negative pressure to prevent the escape of process gases (those gases generated during thermal treatment) and particulates to the atmosphere. Direct-fired kilns can often contribute to the contamination of the material being processed because of the direct contact of the flame or combustion gases.

Heat to directly-heated kilns is provided by fuel combustion inside the shell or by the introduction of preheated gases from outside the shell. Burner firing may be in either a concurrent configuration (with the flow of the feed) or in a countercurrent configuration (against the flow of the feed). Combustion and generated process gases are combined when direct-firing configurations are used therefore greatly increasing the volume of gas (above the generated process gases) that require treatment for particulate and often acid-gas removal. Direct-fired kilns are usually refractory-lined to prevent metal shell erosion, heat loss from the system, and to protect the metal shell from over heating causing loss of structural integrity. Operating temperatures may range up to 2000 to 3000 degrees Fahrenheit depending on the refractory thickness, insulating ability, and the temperature of the outer shell.

Indirectly-heated kilns use burners fired to impinge a flame on the outside of the rotating shell. Combustion and process gases are kept separated during operation of an indirectly-fired kiln, and therefore, the process gases requiring subsequent treatment is significantly smaller than for a directly-fired kiln. Indirectly-heated kilns are usually internally unlined and employ insulated combustion chambers surrounding the outside of the shell to promote heat transfer to the kiln and processed material. Indirectly heated kilns generally operate at temperatures significantly lower than a directly fired kiln because of metal shell temperature limitations. Maximum operating temperatures typically do not exceed approximately 1000 to 1500 degrees Fahrenheit, depending on the shell material of construction.

For both types of kilns, fuel efficiency is quite low since the heat is either passing over the top of the material being treated in a direct-fired kiln or impinging on the outside of the shell during an indirect-fired application. Fuel efficiencies, without waste heat recovery devices, are usually in the 30- to 40-percent range.

Indirectly-heated kilns may also employ numerous resistance-type heaters surrounding the outside of, but not attached to, the rotating shell. For larger-size, rotary kiln-type systems heated in this manner, there is often uneven heating or cooling of the kiln's surface which may result in severe warping of the shell. Also, since the heating apparatus is not attached to (but surrounded by) the shell, energy transfer to the processed material inside the shell is still quite inefficient.

Regardless of the type of rotary kiln, a relatively complicated set of seals (single or double) or end plates is generally required on each end of the rotating shell. These seals or end plates, which are nonrotating and the same diameter as the rotating shell diameter, are particularly critical when it is essential to control the composition of the process gases or prevent the discharge of fugitive emissions to the atmosphere. Because the kiln operates under negative pressure, the seals are usually directly purged (or purged between the seals in the case of double seals that are separated from each other) with relatively large quantities of inert gas, such as nitrogen or steam, to prevent the ingress of air or other vapor into the system. These purge gases contaminate the internal process environment, and when combined with the process gases, significantly increase the total volume of the gases through the shell, therefore requiring increased sizing of down stream vapor-handling equipment.

Because the shell is constantly rotating, the use of instrumentation, such as internal temperature- and pressure-measuring devices, in long kilns is often difficult. The sensing probes are usually introduced through the fixed kiln end plates which limits the zones for taking measurements. Further, the tumbling action of the material being processed, caused by the rotation of the shell, often tends to create excessive dusting resulting in excessive particulate loading of the process vapors. This tumbling action also tends to promote material size segregation.

U.S. Pat. No. 4,931,610 to Hughes et al describes a kiln-type apparatus heated by induction. Alternating current energizing a conducting coil wound around, and insulated from, an internal rotating metal shell generates an alternating electromagnetic field that induces a current in the metal shell. Heat is then generated in the metal shell by electrical resistance of the metal. The shell is not connected directly to the power source, and the rotating shell still requires lip seals for containment of internal gases and exclusion of the outside atmosphere.

U.S. Pat. No. 5,144,108 to Passarotto describes a stationary, cylindrical-type apparatus for the conversion of massicot to litharge. The metal shell is surrounded by, and insulated from, a wound coil energized by an alternating current source similar to that described in the Hughes patent. Material is conveyed through the shell by paddles mounted on a rotating shaft extending the length of the shell. Heat is induced in the metal shell and not connected directly to the power source.

U.S. Pat. No. 4,039,794 to Kasper describes an induction-heated system for heating ferromagnetic abrasive shot in a rotating, cylinder-shape apparatus using lip seals for the exclusion of the external atmosphere from the interior of the cylinder. Also U.S. Pat. No. 3,961,150 to Lewis et al describes an induction-heated device for sterilizing sealed, electrically conductive containers.

Impedance heating of liquids and gases conveyed in pipelines has been used in four basic applications: namely, (1) applying heat to increase the fluidity of static, viscous materials so they can be pumped, particularly for oil transportation through pipelines; (2) maintaining temperature (offset heat loss) of transported liquids and gases flowing through a pipe and for freeze protection; (3) heating fluid liquids and gases passing through a pipe; and (4) heating fluid liquids stored in tanks. Representative examples of materials commonly transported through an impedance-heated line include crude oil, fuel oil, tar, paraffin, resin, sulfur, and chocolate, all of which are fluid and flowable at the elevated temperature of the line.

U.S. Pat. No. 3,777,117 to Othmer describes an impedance heating device suitable for heating fluid in long pipelines relying on the "skin effect" of the pipe's inner surface created by the alternating current. Location of the power cable and the use of internal fins inside the pipeline are used to more effectively transfer the heat to the fluid.

Additional impedance-heated devices disclosed in U.S. Pat. Nos. 3,632,975 and 4,578,564 to Ando and Takagi describe an improved impedance-heated pipe for heating fluids. The invention relates to a long heat-generating pipe utilizing the skin effect of alternating current having one or more impedance elements in the circuit in order to offset nonuniformity of current through the pipeline. U.S. Pat. No. 4,110,599 to Offermann describes a method of reducing the heat output of an impedance-heated pipe by making a segment of the pipe of a non-electrically-conducting or non-ferromagnetic material such as aluminum. U.S. Pat. No. 4,408,117 to Yurkanin describes a "skin effect" impedance heating system for tanks or vessels containing a liquid. A pipe (or several pipes) is inserted through the side of a tank wall, and the insulated power cable is run down the center of the pipe to produce the electromagnetic magnetic flux to generate the "skin effect" heating.

This invention has as its purpose to provide for a processing device or furnace for the thermal treatment of materials which are nonflowable at processing temperatures, while eliminating or overcoming many of the disadvantages or limitations of prior art devices.

SUMMARY OF THE INVENTION

In accordance with this invention, there is provided a processing device, apparatus, furnace, or the like (hereinafter and in the appended claims referred to as a "furnace") comprised of a stationary or nonrotating shell for the thermal treatment of nonflowable, but conveyable, material at the processing temperature. The term "shell" as used herein and in the appended claims is used synonymously with chamber, barrel, cylinder, housing, or the like, through which the material being treated or processed is transported. The shell may be orientated in a substantially vertical position or in a substantially horizontal position. Further, the shell is provided with feed material inlet means disposed near or at one end and spaced outlet means (e.g., outlet means at or near the opposite end) and includes means for conveying the material to be processed through the shell substantially along the major axis from the inlet toward the outlet. It is also understood that the furnace may be operated in a batch filling/discharging mode. In a preferred embodiment of the invention, the shell is disposed in a substantially horizontal position, but the shell may be inclined in either direction somewhat from the horizontal, as explained below in more detail. Thus, it should be understood that the term "substantially horizontal" as used herein and in the appended claims with reference to the shell is intended to include a shell having its central, longitudinal axis or major axis inclined with respect to the true horizontal plane.

A suitable heating element, being electrically conductive, is arranged or disposed in juxtapostition with a substantial portion of the material being treated or processed and extends for a substantial portion of the major axis of the furnace shell. A heating means includes an electrical source and electric cables connected to the electrical source and to the heating element. One cable, or a first cable, supplies electrical energy to the heating element, and another, or second cable, together with the heating element forms a return circuit to the electrical source. Thus, electrical energy supplied to the heating element heats the electrical element by impedance, and thereby heats the material being processed for a sufficient time and to a sufficient temperature to effect thermal treatment. In accordance with one embodiment of the invention, the heating element is the furnace shell, or alternatively the furnace conveying means, or the combination of the shell and conveying means which are independently heated by impedance. In an alternative embodiment of the invention, the heating element may exhibit magnetic properties, commonly referred to as ferromagnetic (iron-like) properties.

The furnace includes means for conveying, carrying, transporting the material along the central longitudinal or major axis of the shell, and such conveying means may be, for example, one or more rotating shafts having pitched ribs (e.g., agitator blades, impellers, screw conveyor, or the like), fluidizing gas (e.g., fluidizing air), or the like. The nonrotating shell is provided with fixed heads or end closures on each end thereby obviating the need for large end seals customarily required for many processing furnaces in order to reduce the influx of air into the furnace or to prevent the leakage or escape of vapors or emissions to the atmosphere. If the process material conveyor means utilizes a rotating conveyor shaft, the only seals required are where the shaft protrudes through the fixed heads. Where desired, the shaft and paddles may serve as the heating element as described herein below in greater detail.

As a result of this invention, the impedance-heated furnace provides numerous advantages over prior art furnaces, and where required, the furnace can be operated more easily in a controlled atmospheric environment (e.g., inert or reactive atmosphere). Typically, seals employed in a heat treating furnace are susceptible to damage and/or deterioration. In accordance with the invention, the heads at each end of the nonrotating shell are fixed on this impedance-heated furnace, and only a minimum number of small seals (i.e., slightly larger than the diameter of the conveyor shaft) are required to seal the conveyor shaft protruding through the fixed heads. Therefore, it is much easier to maintain control of the atmosphere either by preventing the influx or ingress of air or the escape of fugitive emissions. Further, with the impedance furnace, the voltage is easily controlled by means of a transformer connected to a power source (e.g., commercial A.C. power source), and as a result, the heat generated can be controlled to the desired temperature or temperature range depending upon the material being processed in the furnace. Since the furnace is directly connected to the power source, the electrical efficiency may achieve or surpass 90 percent. Also, substantially the entire shell, if utilized as the heating element, is resistant to the flow of current, and heating is substantially uniform through the length and periphery or circumference of the shell. Where zonal heating may be advantageous, the nonrotating shell may be divided into a plurality of sections electrically insulated from each other. Each section is independently heated by its own power source and can be operated at different temperatures. Since the impedance-heated furnace has few external moving parts and uses a commercial power source, the furnace can be more easily insulated and transported than other furnace types.

The furnace of the present invention is especially suitable for thermal desorption, calcination, roasting, heat treating, and drying of nonflowable materials. As explained previously in the Background and Prior Art section, impedance heating devices are in use for heating materials which are liquid or gaseous at the process temperature of the device chamber, such as for transporting viscous materials through a pipeline. Thus, prior art impedance devices have been utilized only for transporting fluid or flowable materials (e.g., oil, tar, chocolate, water, polymers, sulfur, wax, etc.) at relatively low temperatures of generally less than 600 degrees Fahrenheit. In sharp contrast, a wide variety and number of nonflowable materials (nonflowable at the processing temperature) may be treated in the impedance-heated furnace of this invention.

The impedance-heated furnace of this invention is useful for treating such materials as waste oil sludge, wood pulp sludge, sewage sludge, drilling muds, hydrocarbon-contaminated soils, spent catalyst, ores, minerals, inorganic compounds, centrifuge/filter/thickener cakes, solid heat-sensitive materials such as pharmaceuticals, pigments, and plastics, and other like materials. Thus, the furnace is useful for the remediation of soils and sludges, such as soil contaminated with hydrocarbons or organics or refinery waste oil sludges; for the calcination of minerals to other compounds such as converting ammonium molybdate to molybdenum oxide; roasting of ores or ore concentrates such as for converting zinc sulfide to zinc oxide; and drying such as heat-sensitive organic pigments, pharmaceuticals, and plastics. The recovered solids and the process vapors, such as organics and water, are discharged from the shell outlet and preferably recovered for reuse or subsequent disposal.

The furnace of this invention is characterized by high power utilization efficiency and substantially uniform temperature, e.g., substantially uniform shell temperature throughout the length and circumference furnace. Depending on the shell materials of construction, operating temperatures may be as high as about 2000 degrees Fahrenheit, but about 1600 degrees Fahrenheit is a more manageable and useful high operating temperature. When heating needs to be conducted in various steps and temperature gradients, the furnace shell may be constructed of two or more individually electrically-insulated sections each supplied with its own power source and temperature controller. The electrical insulators conform to the circumference of each end of each section, and when the sections are butted together end to end, process material is transported between the sections by a material conveyance means or device operated or extending the entire length of the furnace.

BRIEF DESCRIPTION OF THE ACCOMPANYING DRAWINGS

FIG. 1 is a schematic drawing illustrating the principle of impedance heating.

FIG. 7A is a cross-sectional view of the shaft and paddles taken on lines 7A—7A of FIG. 7.

DETAILED DESCRIPTION OF THE INVENTION

Figure 7:
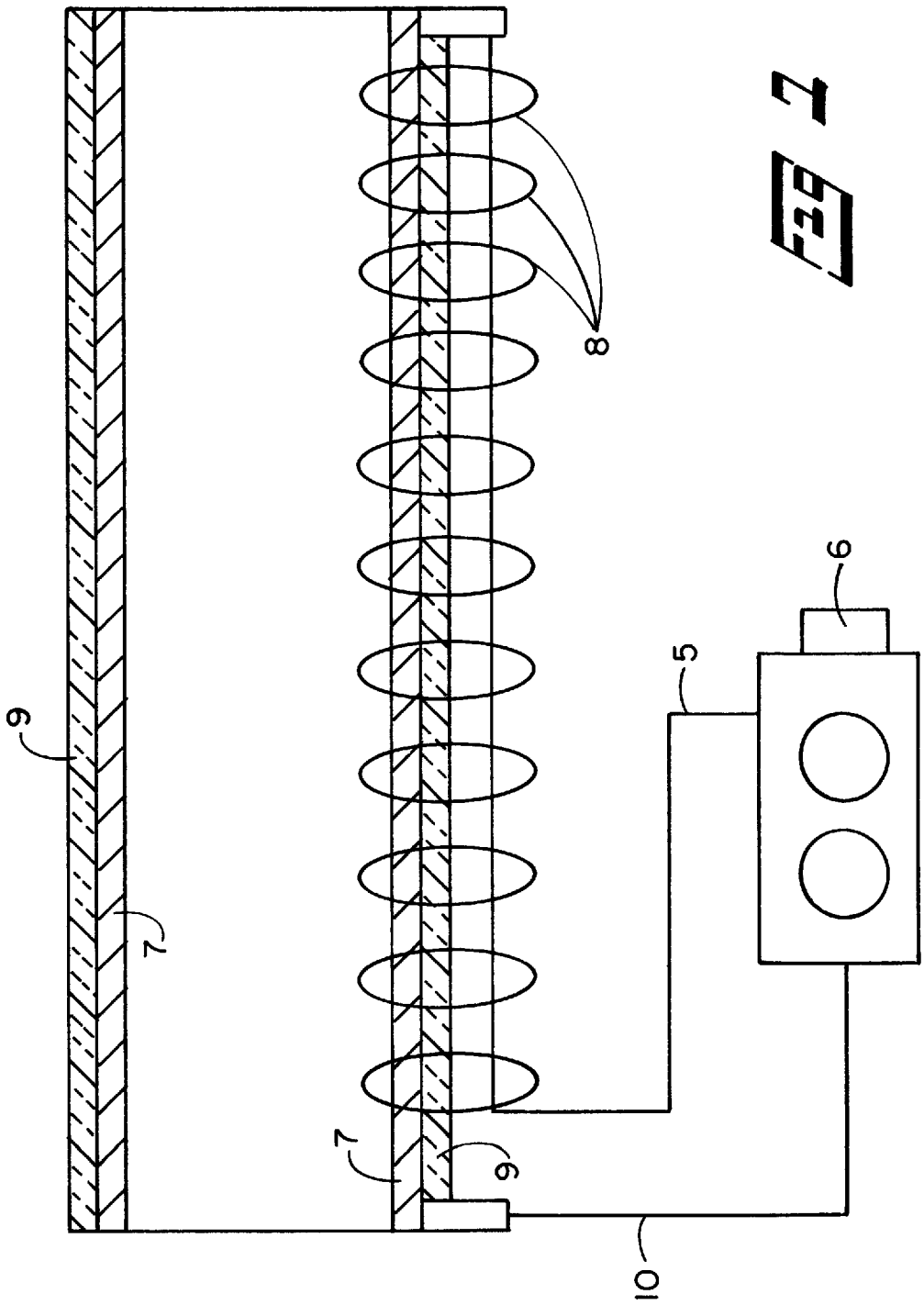
FIG. 7 is a schematic drawing of the conveyance means of a furnace showing means for augmenting and distributing resistance heat to the rotating conveyance means.

In accordance with the invention and as exemplified in the drawings wherein the same reference numerals refer to similar parts throughout the several views, and referring first to FIG. 1, there is shown a schematic representation of an impedance-type device. Impedance heating results when an insulated conductor 5 connected to a power source 6 and attached at one end and running either inside or outside an electrically-conducting metal cylinder, tube, or pipe 7 carries a low-voltage alternating current as the supply leg of the circuit, and the pipe itself and a second insulated conductor 10 acts as the return leg. Heat is actually generated by combining three different electrical effects. The first heat-generating component is caused by the application of alternating current to the pipe 7. The pipe acts as a resistor, and the resistance (heat) generated depends on the supplied voltage, supplied current and the composition, length, and wall thickness of the pipe 7. Additional resistance is also developed if the material transported through the pipe is also electrically conductive. The second heat-generating component is the result of the alternating electromagnetic flux 8 produced by the supply leg causing the alternating current flow in the electrically conducting tube return leg to concentrate on the surface or skin of the pipe 7, thus greatly increasing the resistance and heat produced by the pipe's resistance to the flow of current.

The third factor causes additional heat to be generated by the hysteresis (molecular friction) effect of the alternating magnetic field causing increased resistance to current flow in the conducting pipe 7. The insulated power cable may be installed inside the electrically-conducting pipe 7, but the heat generated by the device is then limited by the ability of the insulated power cable to resist the heat and continue to function (not short out) in the environment. The heated pipe 7 is usually provided with an insulation 9 to prevent the loss of heat to the surrounding environment.

Figure 2:
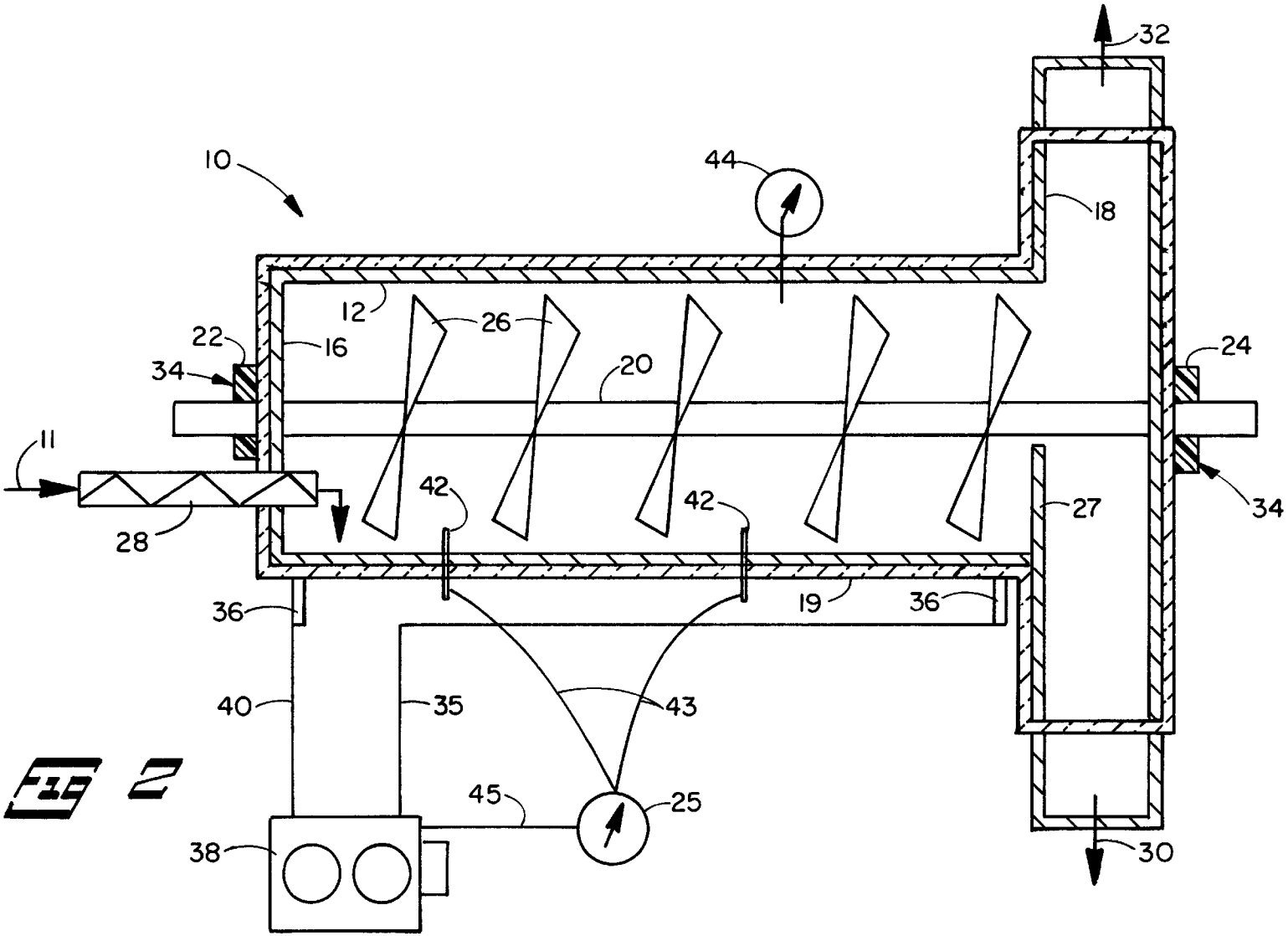
FIG. 2 is a schematic drawing illustrating, partly in cross section a preferred embodiment of the furnace of this invention.

There is shown in FIG. 2 an embodiment of an impedance heating system of the present invention. The system includes an impedance-heated furnace, designated in general by the numeral 10, comprised of a nonrotating shell 12 of a composition exhibiting electrical conductivity and where desired magnetic properties. Suitable metals and alloys include, for example, carbon steel, stainless steel, Incoloy, Inconel, Monel, Hasteloy, Duranickel, nickel, copper, titanium, aluminum, and alloys thereof. In a preferred embodiment, the shell is of cylindrical configuration having its major or longitudinal axis substantially in the horizontal plane. Although a shell of generally cylindrical configuration would be most applicable, it should be understood that the shell may be of any other configuration such as elliptical, rectangular, or polygonal as viewed in cross section. Although the shell as shown, and described in detail, is essentially horizontally disposed, it should be understood that where desired, the shell may be substantially vertically disposed. When operated in a substantially horizontal disposition, the shell may be inclined from the horizontal at an angle of not more than about thirty degrees, and preferably not more than about twelve degrees. It may be desirable to incline the shell so that the inlet end is disposed in a lower position than the outlet end to increase processed material retention time, or conversely having the outlet end below the inlet end to facilitate conveyance of the material. Each end of the cylindrical shell 12 is provided with fixed end plates or caps 16 and 18, which may be formed integrally with the shell, and, preferably have the same, or nearly the same, electrically-conducting property as the shell, and if applicable, the same material and/or magnetic properties as the shell. Where desired, the shell 12 may be provided with an insulation jacket 19, such as high-temperature fire brick, glass wool, or the like, in order to confine the generated heat to the internal furnace heating zone and thereby decrease the loss of heat to the outside environment.

In accordance with this embodiment of this invention, the conveyor means comprises one or more rotating shafts 20 mounted longitudinally through the shell and protrude from fixed heads or end plates 16 and 18, which are fitted with seals 22 and 24, respectively. The seals, which are commercially available, are slightly greater in diameter than the diameter of the conveyor shaft(s), and are constructed (e.g., being spring loaded) to allow for expansion and contraction as the temperature changes. One end of the shaft is operably coupled with a suitable output means or a drive shaft of a suitable drive motor (not shown) or other drive means connected to a power supply (not shown) arranged adjacent to the shell, and understood by one skilled in the art. The opposed end of the driven shaft is supportedly mounted in the opposite end closure or fixed head to permit free rotation or movement of the shaft. In a preferred embodiment, the conveyor means comprises a plurality of pitched agitators or impeller blades 26 spaced equally along the shaft and extending radially therefrom. Although there is shown in the drawings a single train of one shaft with agitators, it should be understood that more than one shaft may be used which can be an advantage in the case of a large-diameter shell. Furnaces with more than one set of shafts and set of agitator blades may have the shafts operating independently, or the agitator blades may be intermeshed to provide for increased material transport, improved mixing, and self cleaning properties. The agitators may be constructed of the same or different material as the shell appropriate for the processing environment (e.g., temperature, erosion, corrosion, etc.). The number of agitator or impeller blades supported by the shaft may vary depending on such factors as length and diameter of the shaft, shaft rotation rate, blade size and pitch, and types of material being processed. The planar portion of the agitators may be positively pitched at an oblique angle relative to the radial plane and in the direction of shaft rotation generally up to about five degrees, preferably in the range of about one-half to two degrees. Where desired, one or more agitators may be pitched in the negative direction to increase processed material retention time and back mixing while the bulk of the material is being transported toward the discharge end of the furnace. The outwardly disposed end of each agitator blade is adjacent to the inner surface of the shell in close, spaced relationship thereto to facilitate nearly complete transport of the processed material through the furnace. A screw conveying device or similar means may also be suitable for material conveyance through the furnace. In an alternative embodiment described below in detail, fluidizing gas (e.g., air) may be used as a means for transporting processed material through the furnace. The discharge end of the shell may be provided with a weir 27 in order to better control the height of material in the shell. Any number of temperature sensing devices 42 and pressure 44 sensing devices may be integrated with the system through the nonrotating shell wall.

An inlet is provided through the fixed end plate 16 at one end of the shell 12 for accommodating feeder 28 of conventional construction (e.g., screw conveyor, live bottom bin, vibrating conveyor, or the like) for supplying material at 11 to the furnace. Separate outlets are provided at the opposite end of the shell for discharging solids at 30 and process vapors at 32. Under some conditions, it may be desirable to remove the vapors from the shell at or near the feed end or midway of the furnace. Associated therewith are suitable conduits and recovery devices such as condensers, scrubbers, settlers, centrifuges, filters, storage units, conveyors, and the like, for transporting and recovering the resulting vapor, liquid, and solid products and byproducts. A portion of the solids may be recycled to the furnace for further treatment or to help maintain the mobility of the process material.

Where desired, a reactive gas such as an oxidizing gas (e.g., air or oxygen), a reducing gas (e.g., carbon monoxide or methane), or alternatively an inert gas (e.g., nitrogen, steam, superheated steam, etc.) may be provided via line 34 through any number of inlets or through the agitator shaft seals 22 and 24. For example, in a roasting or calcining operation for converting material to an oxide, it may be desirable to pass air or oxygen through the furnace. A reducing atmosphere is desirable in the roasting of iron ore. An inert atmosphere is desirable when treating waste oil sludge or organic-contaminated soil to avoid combustion of the contained hydrocarbons and the formation of metal oxides in the treated residual solids, since metal oxides tend to be more leachable and therefore can pollute the soil and groundwater. The gas flow may be in either a countercurrent or concurrent flow to the material being processed.

In order to heat the shell by impedance, an insulated conductor or power cable 35 is connected at one end of the shell 12, such as at terminal 36 positioned at the outlet end of the shell. This power cable or connecting cable 35 extends from transformer 38, fed from a commercial or onsite-generated A.C. power source, and produces the correct and safe voltage for the required heating conditions, which will vary depending upon the material being treated. Secondary voltage supplied to the shell can range from about 1 to 80 volts A.C. The electrically-conductive shell serves as the return leg of the circuit, and the return circuit is completed to the transformer via power cable 40. Thus, heat is generated by impedance in the shell by applying a low A.C. voltage from the transformer. As previously explained, impedance heat is generated as the result of the resistance of the shell, the magnetic field around the conductor which interacts with the shell (having electrically-conductive and ferromagnetic properties), and the hysteresis effect. The resistance or heat generated depends largely on the voltage of the current and the composition, length and wall thickness of the shell. Additional resistance is also developed if the material being heat treated and transported through the shell is electrically conductive. The shell may be provided with one or more temperature sensors 42 and/or pressure sensors 44 connected to suitable controllers. Power from the transformer 38 to the shell 12 is regulated by temperature controller 25 receiving a signal from temperature sensor 42 through cables 43 and 45.

Figure 2A:
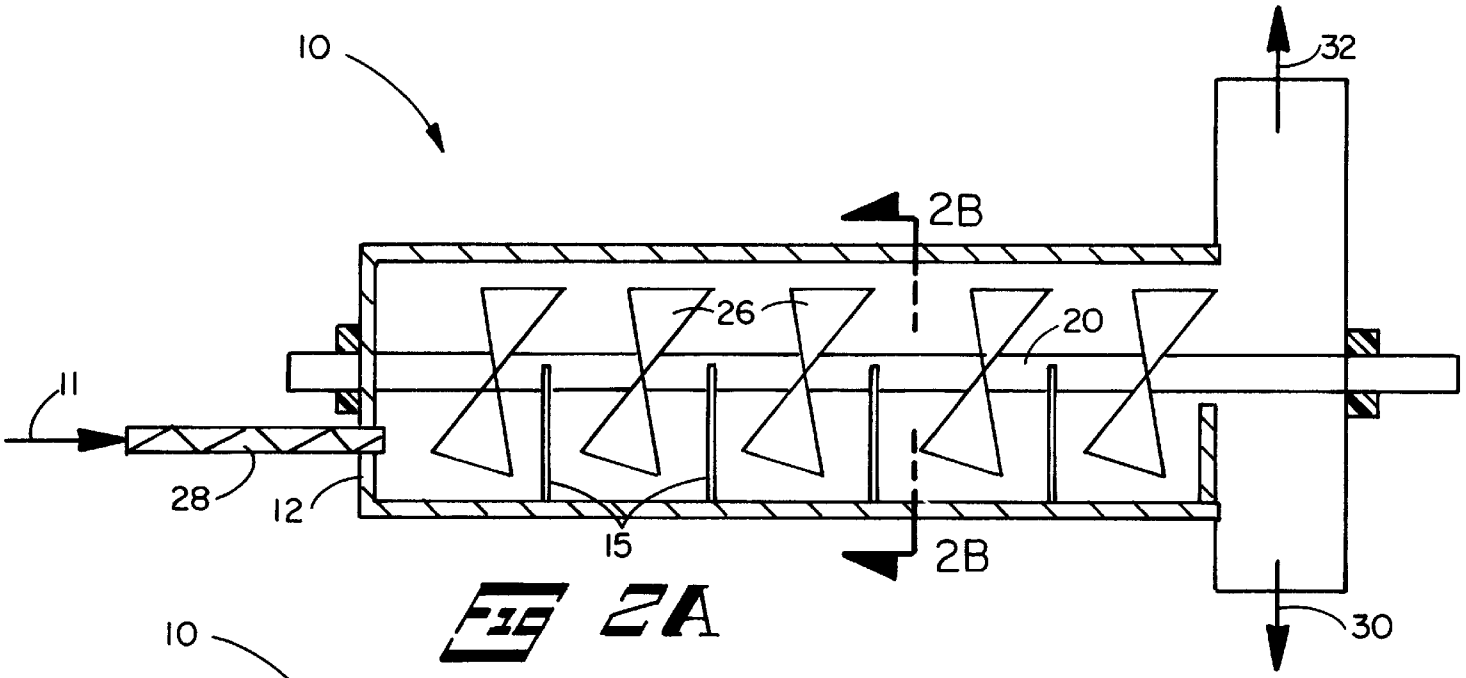
FIG. 2A is a schematic drawing illustrating the furnace embodiment of FIG. 2, but modified to show interior fins or baffles.
Figure 2B:
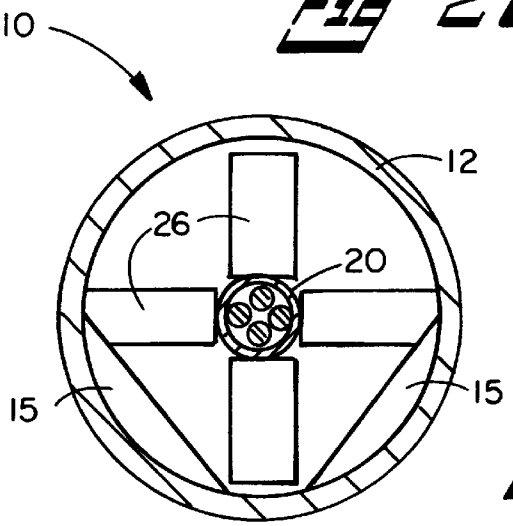
FIG. 2B is a cross sectional view of FIG. 2A taken on lines 2B—2B.
Figure 3:
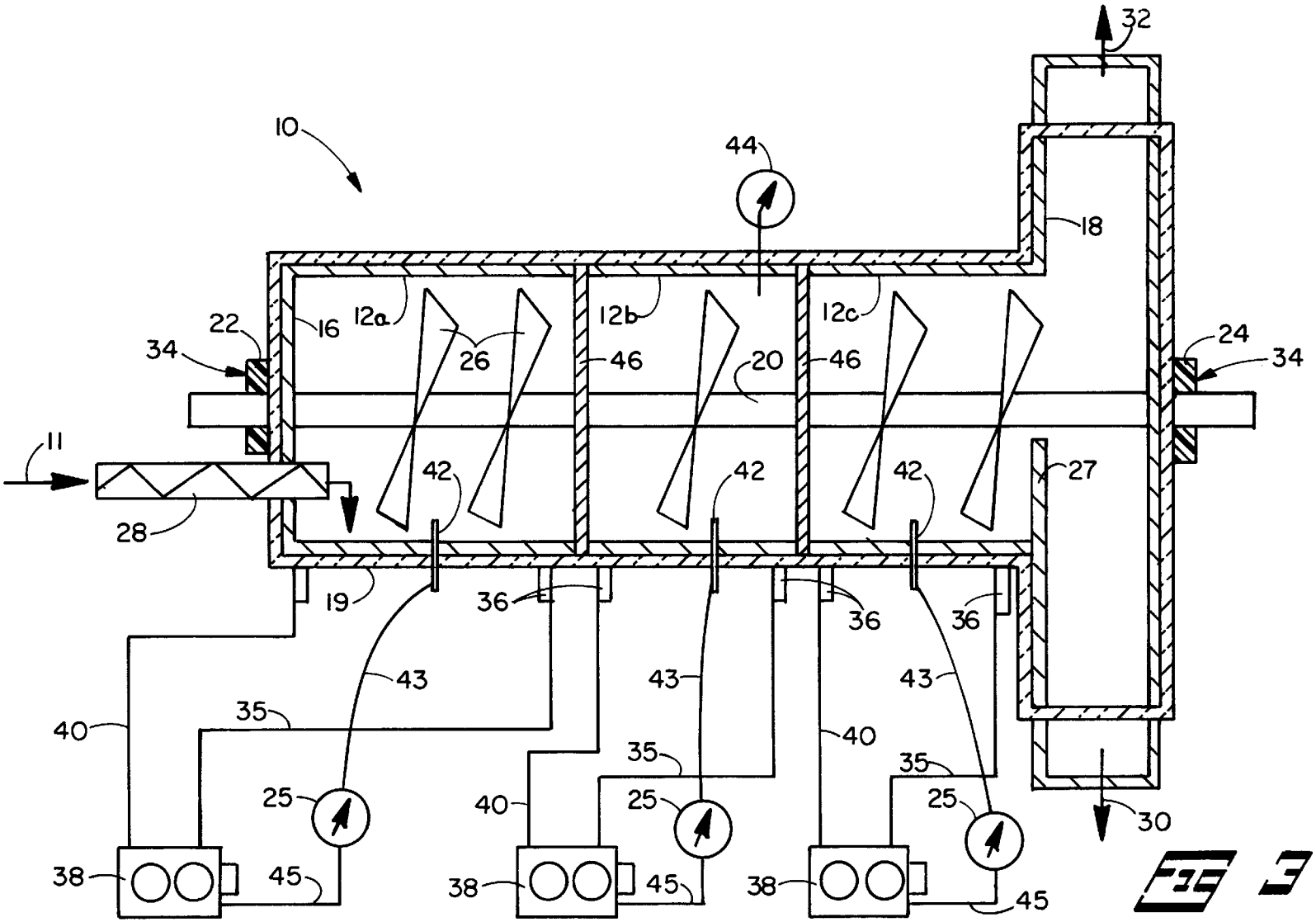
FIG. 3 is a schematic drawing, partly in cross section, illustrating an alternative embodiment of this invention with individually heated furnace sections.

In order to increase the effective contact area, and therefore heat transfer area, between the shell 12 and the material being processed, one or more fins or baffles 15, constructed of the same material as the shell, may be affixed to an internal wall of the shell 12 such as shown in FIG. 2A and FIG. 2B. Heat from the shell will migrate to the fins or baffles 15 as heat is transferred from the fins or baffles to the material being processed. The baffles may be attached perpendicularly to the shell or may be somewhat angled in the direction of material flow to facilitate material transport. Fins or baffles may also be attached to the top wall or to both the top and bottom wall of the shell.

Where it is desirable that the treated material be heated at more than one temperature during its processing, the furnace shell may be separated into multiple, insulated sections as shown in FIG. 3. Each section is supplied with power from a separate power source, so the temperature can be independently controlled in each section. There is shown in FIG. 3 separate shells 12*a*, 12*b*, and 12*c*. Rotating shaft 20, having radially extending agitators 26, extends linearly through fixed end plates 16 and 18 which are nonrotating and have suitable shaft seals 22 and 24. The shell is provided with insulation jacket 19, an outlet weir 27, temperature sensing devices 42 and pressure sensing device 44, a feeder 28, the solids outlet 30, and the vapor outlet 32 substantially as previously described. The shell 12 comprises sections 12*a*, 12*b*, and 12*c* which are separated from each other by electrical insulators 46 such as high-temperature fire brick, ceramics, or the like. The insulators 46 are arranged between adjacent sections so as to abut the marginal walls of each section thereby electrically and thermally insulating one section from the other. Power supply cable 35 is connected to each section at terminal 36, and the circuit is completed within each section via the return leg cable 40 to the transformer 38. A reactive or inert gas may be introduced to the shell through inlet 34. Solids and vapors or gases are recovered at 30 and 32, respectively, as previously explained.

Figure 4A:
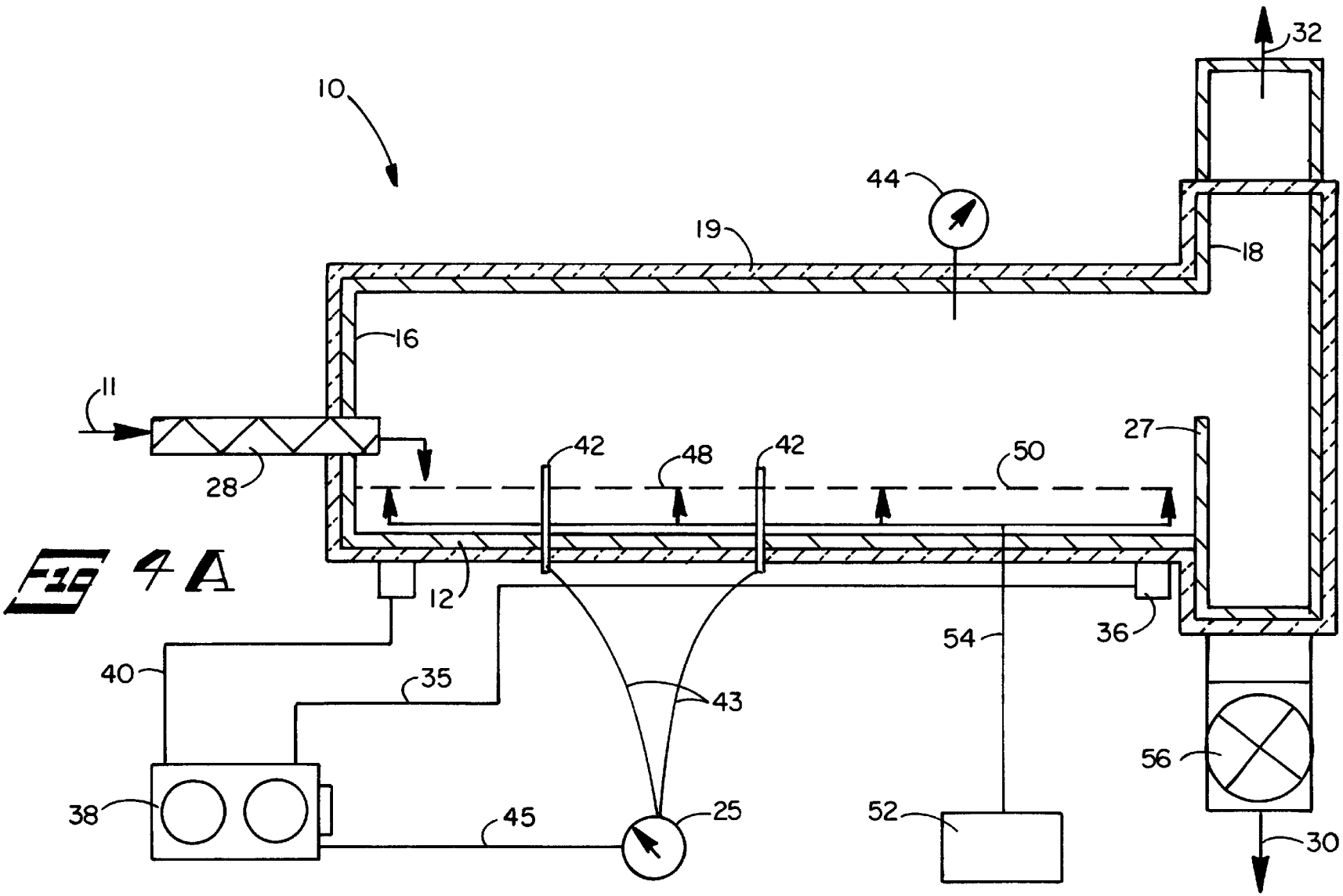
FIGS. 4A and 4B are schematic drawings illustrating yet other embodiments of the invention employing process material fluidizing gas conveyance.
Figure 4B:
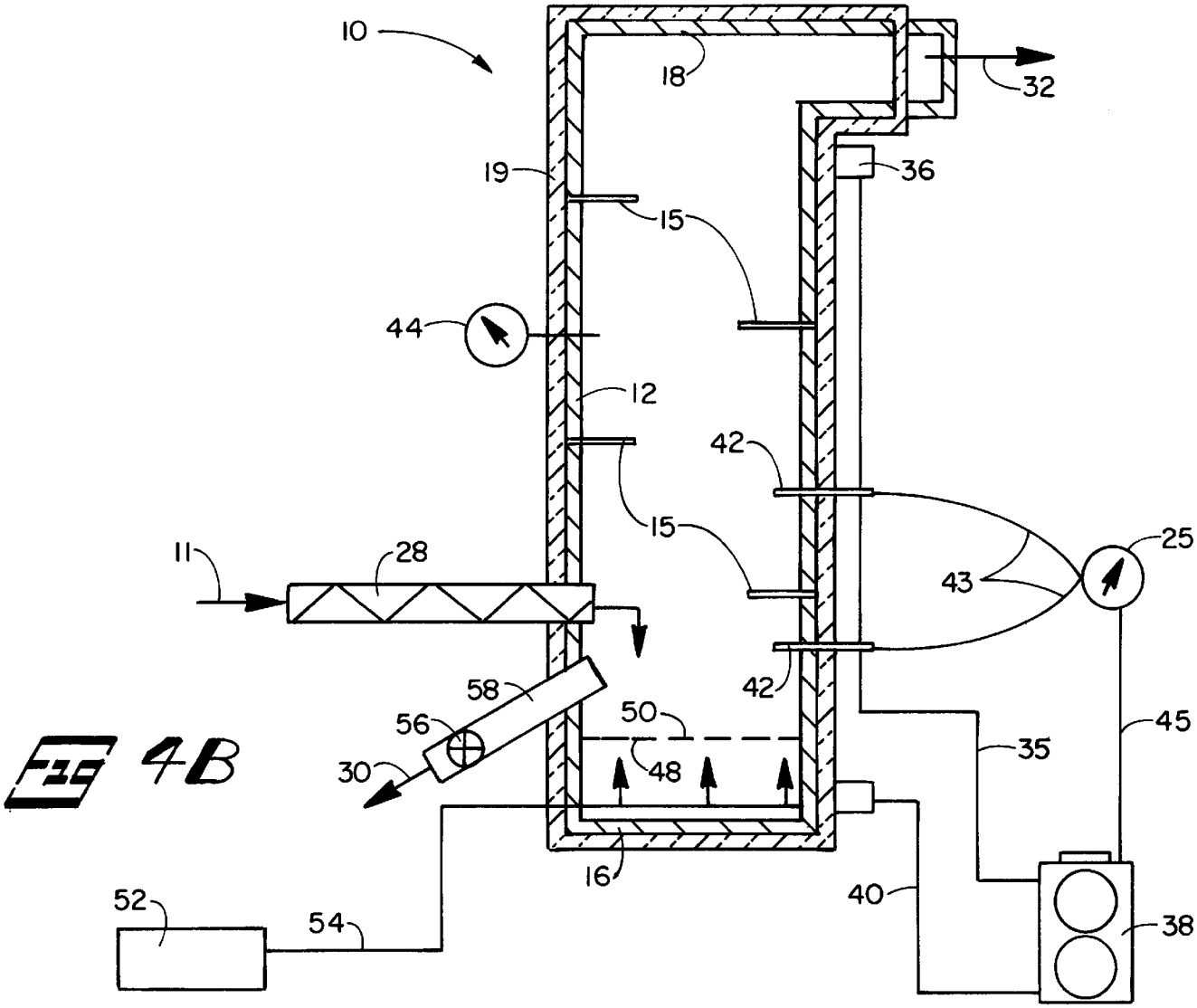

Schematic drawings of impedance-heated furnaces employing fluidizing air as a means of process material transport or conveyance are shown in FIG. 4A and FIG. 4B. It will be observed that the furnace in FIG. 4A is substantially horizontally disposed, and the furnace in FIG. 4B is vertically disposed. In accordance with either of these alternative embodiments, the nonrotating shell 12 is heated by impedance and has fixed end plates 16 and 18 which are nonrotating. The shell is provided with insulation jacket 19, an outlet weir 27, temperature sensing device 42 and pressure sensing device 44, a feeder 28, a solids outlet 30 and a vapor outlet 32, substantially as previously described. A constriction plate 48, having a plurality of orifices 50, is disposed near the bottom of the shell. Fluidizing air (or other gases) supplied by a blower or compressor 52 is distributed to the shell via line 54 through the orifices 50 of the constriction plate 48. A suitable gas (e.g., oxidizing, reducing, or inert gases) passed into the shell penetrates through the process material maintaining it in suspension as a boiling or fluidized bed. In the horizontally disposed furnace shown in FIG. 4A, feed material from feeder 28 and processed material are conveyed or carried through the furnace and over weir 27, down through a removal means 56 such as a star valve, slide gate valve, or the like, providing a means of reducing the flow of vapor out through the solids discharge system. In the vertically disposed furnace shown in FIG. 4B, processed solids 30 carried by the fluidizing gas are removed from the fluidized bed by flowing down removal pipe 58 at a rate controlled by removal means 56. Power supply cable 35 is connected at terminal 36, and the circuit is completed via the return leg cable 40 to the transformer 38. Very fine solid particulates and vapors or gases are recovered at 30 and 32, respectively, as previously explained. Where desired, the fluidizing air may be preheated to aid the impedance heater in the heat transfer operation.

Figures 5, 5A:
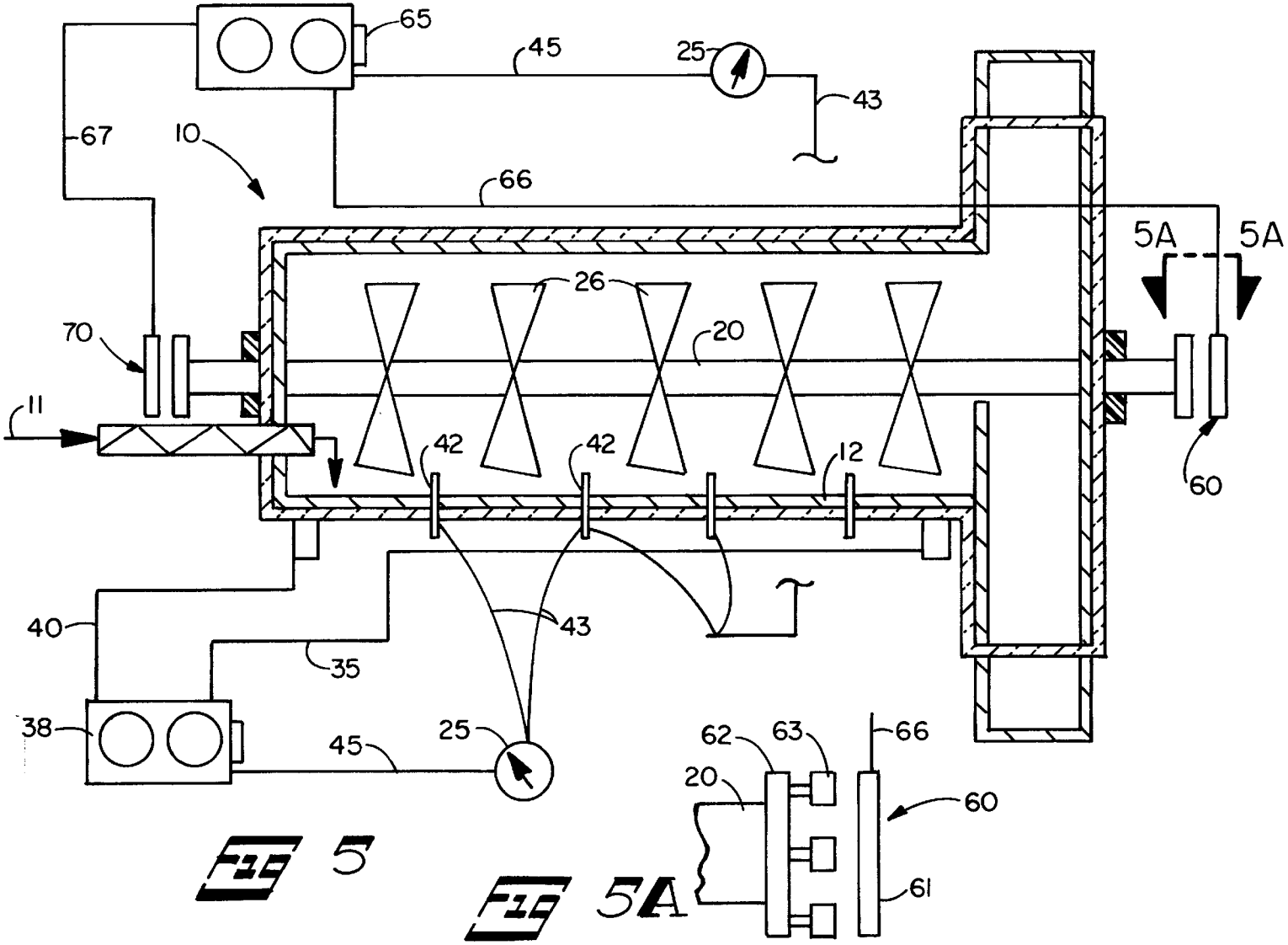
FIG. 5 is a schematic drawing showing in detail the impedance-heated furnace device used in conjunction with a rotating conveyor also heated by impedance means.
FIG. 5A is a plan view showing in more detail the commutator assembly used in the embodiment of FIG. 5.

There is shown in FIG. 5 an alternative embodiment of the invention utilizing a heated conveyor which may be used in conjunction with or separately from an impedance-heated shell. Thus, when a treatment application requires more thermal energy transfer than can be supplied by the non-rotating impedance-heated shell 12 without further increasing the length or diameter of the shell, it may be desirable to introduce the heat from an internal position in conjunction with the impedance-heated shell. One or more previously-described rotating shafts 20 may be fitted on each end with a commutator assembly indicated generally at 60 and 70 for the generation of heat supplied by impedance. Rotating shaft 20 has a composition exhibiting electrically conductive properties and sometimes, where desired, also magnetic properties. Suitable metals and alloys include, for example, carbon steel, stainless steel, Incoloy, Inconel, Monel, Hasteloy, Duranickel, nickel, copper, titanium, aluminum, and alloys thereof. The commutator assembly, shown in more detail in FIG. 5A, is arranged at each end of the shaft 20 with each being a mirror image of the other. The assembly for one end only is described. The commutator, constructed of electrically-conducting material, comprises a fixed section 61 connected to an alternating current (A.C.) power source via cable 66 and a rotating section 62 connected to the shaft 20. The fixed and rotating sections are joined electrically by electrically conducting brushes 63, or the like, suitable for transferring power from the fixed section to the rotating section.

In order to heat the shaft 20 by impedance, an insulated conductor or power cable 66 is connected to one commutator assembly 60 at a terminal on fixed section 61. Power is transferred from the commutator fixed section to the shaft via brushes 63 and the commutator rotating section 62. The power cable extends from transformer 65, fed from a commercial or onsite-generated A.C. power source, and produces the correct and safe voltage for the required heating conditions which will vary depending upon the material being treated. Secondary voltage supplied to the shaft can range from about 1 to 80 volts A.C. The electrically-conductive shaft serves as the return leg of the circuit, and the return circuit is completed to the transformer via a second commutator assembly 70, similarly comprising a rotation section, brushes, a fixed section, and finally by a return power cable 67. Thus, heat is generated by impedance in the shaft by applying a low A.C. voltage from the transformer. As previously explained, impedance heat is generated as the result of the resistance of the shaft, the magnetic field around the conductor which interacts with the shaft (having electrically-conductive and/or ferromagnetic properties), and the hysteresis effect. The resistance or heat generated depends largely on the voltage of the current and the composition, length and thickness of the shaft. Additional resistance is also developed if the material being heat treated and transported through the shell is also electrically conductive. Temperature control of the shaft and treated material transported through the shell is provided by one or more temperature sensors 42 and a temperature controller 25 receiving a signal from the temperature sensors and cables 43 and 45. It should be understood, however, that heat may be supplied to the furnace by utilizing either an impedance-heated shell or an impedance-heated conveyor means or a combination of the two means depending on such factors as furnace size, composition of the shell and shaft, temperature required, overall thermal demand, and material being treated.

Figures 6, 6A:
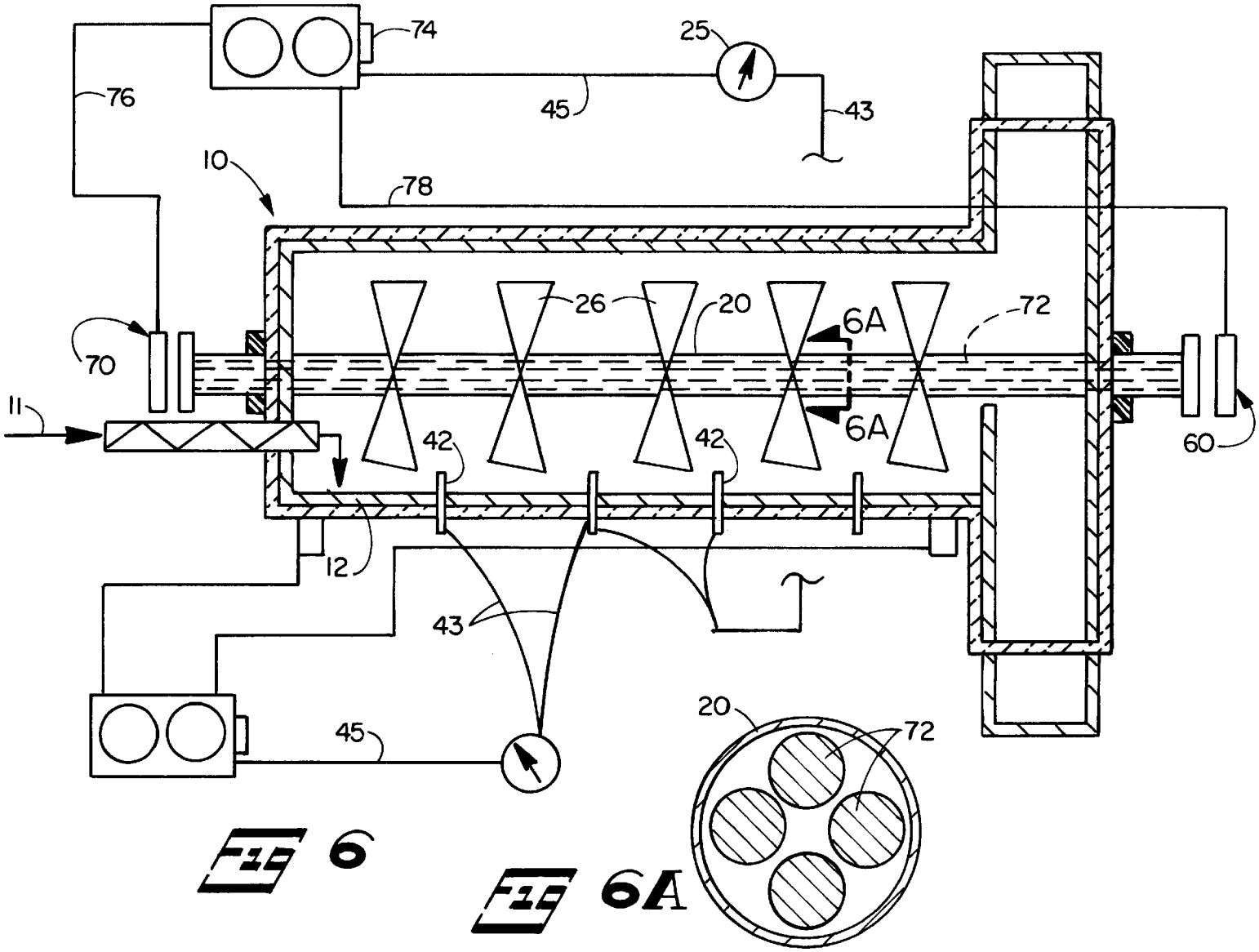
FIG. 6 is a schematic drawing showing still another embodiment of the invention employing resistance heating conveyor means in conjunction with impedance furnace heating.
FIG. 6A is a cross-sectional view taken on lines 6A—6A of FIG. 6.

In yet another embodiment, the non-rotating shell is heated by impedance, as described above, and the conveyor means (e.g., rotating shaft with attached pitched agitators, impellers, or paddles) is heated by electrical resistance. As shown in FIGS. 6 and 6A, the rotating shaft 20 is provided at each end with commutator assemblies 60 and 70 substantially as previously described above. The shaft has one or more axial resistance heating rods or tubes 72 extending the longitudinal length of the shaft. and are connected to the rotating half of the commutator 62 and brushes 63. These heating rods or tubes are standard and commercially available equipment and are constructed of carbon steel, stainless steel, Inconel, copper, nickel, titanium, Monel, or other malleable and suitable metals. Electrical power from an A.C. power source 74 is transferred to the commutators 60 and 70 via lines 76 and 78 and then from the fixed section of the commutators to the rods or tubes 72 via the brushes 63. In this manner, the conveyor means, e.g., shaft, is heated by resistance thereby supplementing the impedance heat from the shell.

Where desired, the heat generated by electrical resistance in the shaft as shown in reference to the embodiment of FIGS. 6 and 6A may be augmented by extending the heating rods or tubes into the conveyor blades. As shown in FIGS. 7 and 7A, longitudinal rods or tubes 72 have a branch or radial extension 78 extending into the conveyor blades 26. In this manner, the blades also are heated by electrical resistance, thereby transmitting heat over a larger surface. The outer terminus of each agitator blade may be provided with a plug 80, or the blades may be constructed in order that they may be disassembled, in order to facilitate access to the heating rods or tubes and for attaching the extensions 78 to the heating rods 72 contained in the shaft.

The impedance-heated furnace is especially useful for thermal desorption, calcination, roasting, and drying of materials nonflowable at the processing temperature. For example, waste refinery sludge or hydrocarbon-contaminated soil, classified hazardous by the Resource Conservation and Recovery Act of 1976, containing a substantial amount of solids and entrained oil and water not removable by mechanical means can be processed in the impedance-heated furnace.

The furnace, operated at a temperature ranging from 225 degrees Fahrenheit to 1150 degrees Fahrenheit, is purged with nitrogen or steam to prevent the combustion of the contained or entrained hydrocarbons and inhibit the formation of metal oxides in the residual solids. Volatilized oil and water are condensed and separated by mechanical means such as gravity, centrifuge, or the like and frequently the oil recovered is a valuable byproduct. The resulting solid material discharged from the furnace is nonhazardous and may be disposed of in a conventional landfill. Also, soil from a creosote wood-treating site, containing hazardous organic constituents, can be treated in a nitrogen- or steam-purged, impedance-heated furnace at temperatures ranging from 225 degrees Fahrenheit to 1150 degrees Fahrenheit to volatilize the organic constituents, and the residual soil may be back-filled into the excavation from which it was removed.

The impedance-heated furnace is useful for calcining or roasting ores, concentrates, minerals, or compounds. For example, ammonium dimolybdate is converted to molybdenum oxide by heating to 700 degrees Fahrenheit in the impedance-heated furnace in the presence of air with a conveyor means operating to mix and convey the material. Similarly, calcium carbonate is heated in an impedance-heated furnace at 1800 degrees Fahrenheit with a conveyor rotating to mix and convey the material to form calcium oxide, or zinc sulfide is calcined at approximately 1200 degrees Fahrenheit to form zinc oxide. Also, these materials can be treated in a fluidized bed by heating to the appropriate temperature in an impedance-heated furnace with fluidizing air introduced through an air dispersion system as previously described.

Having described this invention and certain embodiments thereof, it is claimed:

1. A processing furnace for the thermal treatment of nonflowable, but conveyable material at the processing temperature, comprising: (a) a nonrotating shell having a major axis; (b) inlet means at about one end of the said shell and outlet means spaced from said inlet means; (c) means operatively disposed in said shell for conveying said material to be processed substantially along said major axis of said shell; (d) a heating element, being electrically conductive, in juxtaposition with a substantial portion of said material and extending for a substantial portion of said major axis; and (e) means for heating by impedance said heating element including (i) an electrical source and (ii) first and second electric cables connected to said electrical source and to said heating element, said first cable for supplying electrical energy to said heating element, and said second cable and said heating element forming a return circuit to said electrical source; wherein electrical energy supplied to said heating element heats said heating element by impedance.

2. A processing furnace according to claim 1 wherein said heating element is said shell.

3. A processing furnace according to claim 1 wherein said heating element is said conveying means.

4. A processing furnace according to claim 2 wherein said heating element also includes said conveying means and further including a second heating means for independently heating said conveying means by impedance.

5. A processing furnace according to claim 2 wherein said conveying means includes a resistance heating means, and means to supply A.C. electrical energy to said resistance heating means for heating said conveying means by electrical resistance.

6. A processing furnace according to any one of claims 1–5 wherein said heating element has magnetic properties.

7. A processing furnace according to any one of claim 1–5 wherein said shell is substantially horizontally disposed.

8. A processing furnace according to claim 6 where the processing temperature is from about 225 to about 2000 degrees Fahrenheit.

9. A processing furnace according to claim 8 wherein said higher temperature is about 1600 degrees Fahrenheit.

10. A processing furnace according to claim 7 wherein said material treated comprises a solid having entrained volatiles, said impedance heating being sufficient to volatilize said entrained volatiles, and further includes means for recovering resulting treated solids and means for condensing and recovering the resulting volatiles.

11. A processing furnace according to claim 10 further including means for recycling at least a portion of recovered solids to said shell.

12. A processing furnace according to claim 7 wherein said shell is insulated.

13. A processing furnace according to claim 7 wherein said shell is inclined from the horizontal by not more than about 30 degrees.

14. A processing furnace according to claim 7 wherein said shell is inclined from the horizontal by not more than about 12 degrees.

15. A processing furnace according to any one of claims 1 through 5 wherein said shell has at least two connecting sections in direct communication, means for electrically insulating each section from each adjacent section, said inlet means and said outlet means at oppositely disposed ends of said shell, and heating means for independently heating by impedance each shell section.

16. A processing furnace according to any one of claims 1–5 further including means for controlling the atmospheric environment in said shell.

17. A processing furnace according to claim 16 including means for introducing a reactive gas to said shell.

18. A processing furnace according to claim 16 including means for introducing an inert gas to said shell.

19. A processing furnace according to claims 1 or 2 wherein said means for conveying said material comprises means for introducing a fluidizing gas to said shell at a zone below said major axis.

20. A processing furnace according to any one of claims 1 through 5 further including fixed heads at opposed ends of said shell, mechanical seals disposed in each fixed head, and said conveying means comprising a rotatable shaft extending in parallel with said major axis of said shell and supportably mounted in said seals to permit rotation of said shaft, and having a plurality of pitched agitators spaced axially along said shaft and extending radially therefrom.

21. A processing furnace according to claim 20 wherein said shell is inclined from the horizontal by not more than about 30 degrees.

22. A processing furnace according to claim 20 wherein said shell is inclined from the horizontal by not more than about 12 degrees.

23. A processing furnace according to claim 22 wherein said shell has a least two connecting sections in direct communication, means for electrically insulating each section from each adjacent section, said inlet means operatively disposed in said shell and said outlet means at oppositely disposed ends of said shell, and means for independently heating by impedance each shell section.

24. A processing furnace according to claims 1 or 2 wherein said shell is substantially vertically orientated, and said means for conveying said material comprises means for introducing a fluidizing gas to said shell.

25. A processing furnace according to any one of claims 2, 3, 4, or 5 further including one or more fins affixed to the internal wall of said shell and being of substantially the same electrically conductive material as said shell.

26. A processing furnace for the thermal treatment of nonflowable, but conveyable, material at the processing temperature, comprising: (a) a substantially horizontally disposed, nonrotating shell having a major axis and having electrically conductive properties; (b) inlet means at about one end of said shell and outlet means spaced from said inlet means; (c) fixed heads at opposed ends of said shell; (d) mechanical seals disposed in each fixed head; (e) means for conveying said material to be processed through said shell substantially along said major axis from said inlet toward said outlet, said conveying means including at least one rotatable shaft extending in parallel with said major axis and supportably mounted in said seals to permit rotation of said shaft, and said shaft having a plurality of pitched ribs spaced axially along said shaft and extending radially therefrom; (f) means for controlling the atmospheric environment in said shell; and (g) means for heating by impedance said shell including (i) an electrical source and (ii) first and second electric cables connected to said electrical source and to said shell, said first cable for supplying electrical energy to said shell, and said second cable and said shell forming a return circuit to said electrical source; wherein electrical energy supplied to said shell heats said shell by impedance.

27. A processing furnace according to claim 26 wherein said conveying means is heated by impedance by a second heating means having a second electrical source and third and fourth electric cables connected to said electrical source and to said conveying means, said third cable for supplying electrical energy to said conveying means, and said fourth cable and said conveying means forming a return circuit to said electrical source; wherein electrical energy supplied to said conveying means heats said conveying means by impedance.

28. A processing furnace according to claim 26 wherein said means for controlling the atmospheric environment includes means for introducing a reactive gas to said shell.

29. A processing furnace according to claim 26 wherein said means for controlling the atmospheric environment includes means for introducing an inert gas to said shell.

30. A processing furnace for the thermal treatment of nonflowable, but conveyable, material at the processing temperature, comprising: (a) a substantially vertically disposed, nonrotating shell having a major axis and having electrically conductive properties; (b) inlet means above the lower end of said shell and outlet means spaced from said inlet means; (c) means for introducing a fluidizing gas to said shell below said inlet means for fluidizing said material to be processed in said shell substantially along said major axis; and (d) and means for heating by impedance said shell including (i) an electrical source and (ii) first and second electric cables connected to said electrical source and to said shell, said first cable for supplying electrical energy to said shell, and said second cable and said shell forming a return circuit to said electrical source; wherein electrical energy supplied to said shell heats said shell by impedance.

31. A processing furnace according to claim 30 further including means for preheating the fluidizing gas.

32. A processing furnace according to claim 30 wherein the fluidizing gas comprises a reactive gas.

33. A processing furnace according to claim 30 wherein the fluidizing gas comprises an inert gas.

34. A processing furnace according to any of claims 30 through 33 further including one or more fins affixed to the internal wall of said shell and being of substantially the same electrically conductive material as said shell.

35. A processing furnace according to any one of claims 30 through 33 wherein said shell has at least two connecting sections in direct communication, means for electrically insulating each section from each adjacent section, and heating means for independently heating by impedance each shell section.

36. A process for the thermal treatment of nonflowable, but conveyable material at the processing temperature, comprising: (a) providing a nonrotating shell having a major axis and inlet means at about one end of said shell and outlet means spaced from said inlet means; (b) conveying said material to be processed through said shell by means operatively disposed in said shell and substantially along said major axis from said inlet toward said outlet; (c) providing a heating element, being electrically conductive, in juxtaposition with a substantial portion of said material and extending for a substantial portion of said major axis; (d) heating by impedance said heating element including providing (i) an electrical source and (ii) first and second electric cables connected to said electrical source and to said heating element, said first cable for supplying electrical energy to said heating element, and said second cable and said heating element forming a return circuit to said electrical source; wherein electrical energy supplied to said heating element heats said electrical element by impedance and thereby heats said material; and (e) recovering the products of said heating step.

37. A process according to claim 36 wherein said heating element is said shell.

38. A process according to claim 36 wherein said heating element is said conveying means.

39. A process according to claim 37 further including a second heating element for independently heating said conveying means by impedance.

40. A process according to any one of claims 36 through 39 wherein said heating element has ferromagnetic properties.

41. A process according to any one of claims 36 through 39 wherein said conveying means comprises a mechanical conveying means internally disposed in said shell for a substantial portion of said major axis.

42. A process according to any one of claims 36 through 39 wherein said shell is substantially horizontally disposed and said processing temperature is from about 225 degrees to 1600 degrees Fahrenheit.

43. A process according to any one of claims 36 through 39 wherein said material treated comprises a solid having entrained volatiles, heating by impedance said material sufficient to volatilize said entrained volatiles, controlling the atmospheric environment in said shell during said heating step, and recovering resulting treated solids and resulting volatiles.

44. A process according to claim 43 wherein said atmospheric environment comprises a reactive gas.

45. A process according to claim 43 wherein said atmospheric environment comprises an inert gas.

* * * * *